United States Patent [19]

Klein et al.

[11] 4,367,487

[45] Jan. 4, 1983

[54] APPARATUS FOR TAKING MEASUREMENTS FOR THE EVALUATION OF VIDEO CAMERA IMAGES FOR TAPE EDGE REGULATION

[75] Inventors: Herrmann Klein, Reichshof; Peter Pelweckyj, Heusenstamm; Ludwig Menzel, Olpe-Biggesee, all of Fed. Rep. of Germany

[73] Assignee: Elektro-Mechanik GmbH, Olpe, Fed. Rep. of Germany

[21] Appl. No.: 298,182

[22] Filed: Aug. 31, 1981

[30] Foreign Application Priority Data

Sep. 2, 1980 [DE] Fed. Rep. of Germany ..... 3032950

[51] Int. Cl.[3] ..... H04N 7/18

[52] U.S. Cl. ..... 358/107; 250/571; 235/92 MP; 358/101; 364/830

[58] Field of Search ..... 358/107, 101, 93, 100; 250/571, 560, 561; 235/92 CC, 92 DN, 92 CA, 92 PD, 92 MP; 364/830

[56] References Cited

U.S. PATENT DOCUMENTS

| | | | |
|---|---|---|---|
| 3,219,894 | 11/1965 | Rösch | 358/101 |
| 3,261,967 | 7/1966 | Rosin | 358/107 |
| 4,188,544 | 2/1980 | Chasson | 358/107 |

FOREIGN PATENT DOCUMENTS

| | | | |
|---|---|---|---|
| 934215 | 8/1963 | United Kingdom | 358/107 |

OTHER PUBLICATIONS

*Sensor Review*, vol. 1, No. 2, (Apr. 1981), P. Loose, "Finding the Edge on Steel with Stereoscopic Vision", pp. 60–65.

*Primary Examiner*—Howard Britton
*Attorney, Agent, or Firm*—Spencer & Kaye

[57] ABSTRACT

Apparatus for evaluating optoelectronically generated picture rasters wherein, for the purpose of regulating the tape movement of a tape-shaped material (tape), the tape position is detected with the aid of a video camera by continuously reproducing an edge of the tape or a marking line on the tape as a sudden change in contrast, each picture raster or frame is scanned line-by-line for the purpose of evaluation and the picture elements in each line occurring up to the selected sudden change in contrast are counted by means of a picture element counter, and the count is used to provide an analog output signal, by means of a digital/analog converter, which is used to form a setting instruction to mechanically adjust the tape position to the desired position. The input signal to the digital/analog converter is provided by the output of a second counter which serves as a memory having a counting content of picture elements corresponding to the previously detected tape position. The input of this second counter is connected, via a precounter, to a digital comparator whose two inputs are connected with the outputs of the first and second counters. The digital comparator and the precounter are designed such that the precounter is advanced or set back by one counting pulse whenever the number of picture elements counted in one line of the picture raster until the occurrence of a sudden change in contrast is greater or smaller, respectively, than the number of picture elements stored in the second counter, and the precounter emits a signal which changes the counting content of the second counter by plus or minus one, and the precounter is returned to the starting state, if its counting content reaches a given value by algebraic addition of its input signals. An analog version and a modified digital version are also disclosed.

5 Claims, 2 Drawing Figures

APPARATUS FOR TAKING MEASUREMENTS FOR THE EVALUATION OF VIDEO CAMERA IMAGES FOR TAPE EDGE REGULATION

BACKGROUND OF THE INVENTION

The present invention relates to an apparatus for evaluating, by way of measurements, optoelectronically-produced raster image in which, for the purpose of regulating the movement of a tape- or band-shaped material (hereinafter called a tape), the position of the tape is detected, with the aid of a video camera, by continuously reproducing one edge of the tape, or a marking line on the tape, as a sudden change in contrast. More particularly, the present invention relates to such an apparatus wherein, for the purpose of evaluation, each picture raster or frame is scanned line-by-line and the picture elements, e.g., dots, in each line are counted by means of a picture element counter until the selected change in contrast occurs and then the counting result is converted, by means of a digital/analog converter, into an analog output signal from which an adjustment order is formed which mechanically brings the tape position into the desired position.

Known tape movement regulators are closed control circuits in which measuring members measure, usually without contact, the momentary position (actual position) of the edges of the panel of the band- or tape-shaped material to be transported and thus detect its position. Photoelectric measuring barriers, inductive measurement sensors or pneumatic sensors are used for this purpose.

The periodical "VDI-Nachrichten" No. 23. 1980, page 6, also discloses cases in which the tape edge and tape position are monitored on a monitor with the aid of a television or video camera and simultaneously a video signal is generated which measures and detects the position of the tape edge. Such uses are applicable, for example, for steel and stainless steel tapes which pass at high speed through a heat-treatment furnace wherein tape temperatures of more than 1000° C. are realized and a large quantity of tape can be supplied. Such uses require special techniques of contactless measurements on the tape edges of the purpose of guiding the tape in a centered position. These measurements are made with the aid of two industrial use television cameras which are mounted in symmetry with the center of the system and operate through a heat-resistant observation window, with the cameras being water-cooled while their cable inputs and their front optical systems, as well as the illumination devices required for the detection, are air-cooled.

The problem in optically monitoring the tape position is to assure sufficient bright-dark contrast (sudden change in contrast) at the tape edges over the entire temperature range from about 20° C. to more than 1000° C. attained by the tape-shaped material (tape), as well as in the interior of the furnace, which is realized with measures of the above-mentioned special technique, inter alia, by extraneous illumination of the tape in the viewing field of the camera.

In a video camera, the optical picture content projected in the image converter plane by the front optical system is divided into a picture element raster which is electronically scanned successively line-by-line and results in an optoelectronically generated picture raster or frame. At the same time and in synchronism with the line-by-line scanning, the image content is reproduced on the associated monitor.

The optical detection of the tape position with the aid of video cameras and the evaluation of the optoelectronically-generated picture raster can be effected, in principle, in two ways;

1. With the aid of a video camera, the moving tape is covered or observed over an area extending beyond the entire width of the tape, i.e., both tape edges are covered. From the resulting picture or frame, an electronic output signal is formed on the basis of the evaluation of the positions of the two tape edges and this signal is proportional to the center position of the tape.

2. With the aid of two video cameras, which are arranged symmetrically to the center of the system, the two edges of the moving tape are covered or observed separately and the two pictures or frames produced optoelectronically in this way are each evaluated during their generation by means of a device which includes the above-described features.

The horizontal scanning of the picture content of the two cameras is done in opposite directions. The two electrical output signals obtained from the evaluation are both proportional to the distance between the edge position and the beginning of the measuring range and the difference between these two signals is proportional to the center line of the tape. In each picture line, the number of picture elements from the beginning of a line to the sudden change in contrast is counted during the scanning and is converted, by means of a digital/analog converter, into an analog signal, or the position of the sudden change in contrast is determined by integration to provide an analog signal.

However, it is possible, particularly in continuous flow heat-treatment furnaces, for weak light-dark contrasts or color contrasts to appear at the edges of the tape which are no longer detected as such in the image converter of the video camera, so that error measurements result which produce errors in the evaluation. If, for example, no sudden change in contrast is detected in some lines of the pictures or frames, then the output signal of the picture evaluation during this period corresponds to the evaluation that the field of view of the camera and including the tape is completely covered or that the tape is presently not visible or not present at all. Moreover, if sudden changes in contrast appear in some lines of the pictures at the wrong positions of the tape due to soiling or as a result of false flashes, the output signal during this period corresponds to values which indicate that during the time in question, the tape edge is not moving, i.e., part of the tape is damaged, or, if the reason is a longer stretch of soiling, that the movement of the tape is shifted in the viewing range.

For these reasons, the known evaluation devices exhibiting the above-mentioned features and operating as described above are not suited to differentiate between the above-mentioned events or malfunctions and actual interference with the movement of the tape, i.e., they are unreliable.

SUMMARY OF THE INVENTION

It is, therefore, the object of the present invention to provide an evaluation circuit or system of the above-mentioned type in which the output signal is not influenced by a lack of a sudden change or transition in contrast in the pictures or by erroneous contrast indications due to soiling in the viewing range or possible spots on the camera tube or on the front optical system of the video camera which spots do not extend over a large number of lines of the raster.

The above object is achieved according to one embodiment of the present invention in that in a digital evaluation circuit, as described above, a second counter, a digital comparator and a precounter are additionally provided. The second counter functions as the output counter of the circuit, e.g, has its output connected to the digital-to-analog converter and serves as a memory counter with a counting content of picture elements corresponding to the previously covered tape position. The input of this second counter is in operative connection with the output of the digital comparator via the precounter which has two outputs which are connected with the inputs of the output or second counter, and first and second inputs. The digital comparator, which has two inputs connected respectively to the output of the first counter, i.e., the picture element counter of the known circuit, and to the output of the second counter, has first and second outputs connected respectively with the first and second inputs of the precounter. The digital comparator and the precounter are each designed such that the output signals from the digital comparator cause the precounter to be advanced or set back one counting step depending on whether the number of picture elements counted in one row of the picture raster until a sudden change in contrast occurred is larger or smaller, respectively, than the number stored in the output or second counter, and such that the outputs of the precounter emit a signal which changes the counting content of the second counter by plus or minus one, and the precounter is brought to its starting state, if the counting content of the precounter has reached a preselected value by algebraic addition of its input signals.

For some applications, the demands are lower than those discussed above. In such cases, according to a further embodiment of the invention, the use of the precounter can be omitted. According to this further embodiment of the present invention, only the digital comparator and the second or output counter described above are provided with the second counter again being used as the output counter of the circuit and as a memory having a counting content (B) of picture elements which corresponds to the previously detected tape position and with the digital comparator again comparing the content of the first and second counters. The two inputs of the second counter are in operative connection with the two outputs of the digital comparator, and the digital comparator and the second counter are designed such that if the number (A) of picture elements counted in one line of the picture raster until the occurrence of a sudden change in contrast is greater or less than the number (B) stored in the output counter, a signal which changes the counting content of the output or second counter by plus or minus one, respectively, is given to the inputs of the output counter.

According to a further feature of the present invention, the digital comparator is provided with a third output and the evaluation circuit is additionally equipped with a further counter with a monitoring function and which has two inputs and one output. This further or monitoring counter counts the lines of the picture raster in that the third output of the digital comparator is connected with a first input of this monitoring counter, and a signal is emitted by the digital comparator to the first input of the monitoring counter when the number of picture elements (A) counted in the line of a picture raster or frame until the occurrence of a sudden change in contrast in only slightly less or greater than the number (B) stored in the second or output counter, but a signal, which is evaluated as a message of interference or malfunction, is generated at the output of the monitoring counter only if the number of those lines counted is less than a preselected minimum number fed in at the second input of the monitoring counter by a separate means.

The present invention further relates to a circuit system of the above-described type wherein, for the evaluation of optoelectonic picture rasters or frames, analog circuits instead of digital circuits are used, so that the use of a digital/analog converter at the output is not required. In such a circuit arrangement, each picture raster is likewise scanned line-by-line for the purpose of evaluation and an analog integrator is started at the beginning of each picture raster line and is stopped when a sudden change in contrast is detected so that an analog output signal is generated from which a setting instruction is formed which mechanically controls the tape into the desired position.

In this respect, the object of the present invention is the same as explained above with respect to the digital embodiments, with the difference that an evaluation circuit employing analog circuits and having the above-stated features is to be provided in such a manner that the output signal of the evaluation circuit remains uninfluenced by the absence of sudden changes in contrast in the picture rasters or by error contrasts, if the demands to be met with respect to interference suppression are less than those in the problem discussed above.

This object is achieved according to a further embodiment of the invention in an analog evaluation circuit in that in addition to the analog integrator mentioned above, an analog comparator and a second analog integrator are provided. The second integrator serves as the output memory of the evaluation circuit, with the analog voltage of this second integrator corresponding to the analog voltage of the previously detected tape position. This second integrator has two inputs which are operatively connected with two outputs of the analog comparator. The analog comparator is designed such that a small voltage value is emitted at its first output so that, during the line scanning period, the output voltage of the memory or second integrator is increased if the output voltage of the first analog integrator is higher at the moment of the sudden change in contrast than the voltage of the second integrator, and a voltage of the opposite polarity with the reverse effect is emitted at its second output if the output voltage of the first analog integrator is less than the voltage of the second integrator at the moment of the sudden change in contrast.

The capability of the entire circuit as discussed above, including the comparator with three outputs and with the precounter and additional monitoring counter, is significant in that it makes the evaluation possible, it differentiates between malfunctions in the movement of the tape, particularly changes in the tape position, contrasts checks in the rows of the picture rasters which are missing or two weak, and the above-mentioned error contrasts, and it prevents the emission of error information regarding the tape position. The evaluation remains sufficiently reliable even if up to 90% of the picture lines to be emitted show no sudden change in contrast.

For the evaluation, the precounter takes on the function of an averaging of the row information in the sense that the content and counting state of the second or output counter is changed by the precounter by one counting step more or one counting step less only if the precounter itself has been advanced or reset, respectively, by the preselected number of unit counting steps which have been algebraically added upon the receipt of a series of line informations A>B and/or A<B via the respective output lines of the comparator. This preselected number is 8, for example, if a 3-bit precounter is used. The averaging prevents the counting state B of the output counter from being changed at the "wrong places" in the picture lines during the detection of sudden changes in contrast. If, as a result of such wrong line information, an interference occurs in a complete so-called half-frame picture, then the counting state of the output counter is changed by only a few counting steps. In spite of this strong interference suppression, the dynamics of the tape position regulation are not worsened, however.

BRIEF DESCRIPTION OF THE DRAWINGS

In all figures, the same circuit blocks are indicated with the same reference numeral.

DETAILED DESCRIPTION OF THE PREFERRED EMBODIMENTS

Figure 1:
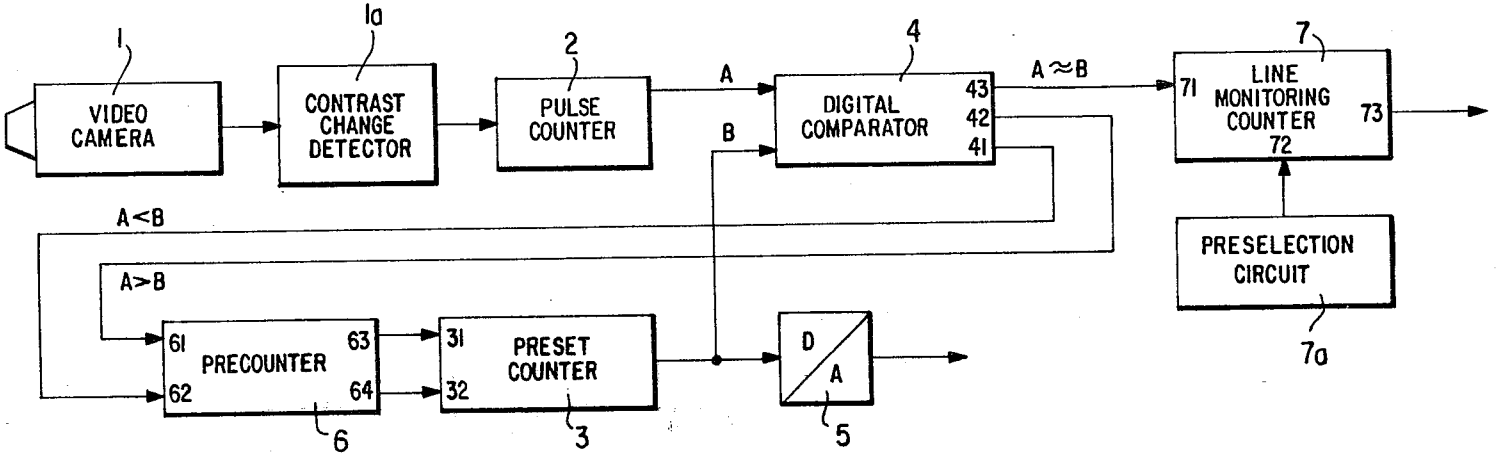
FIG. 1 is a block circuit diagram of a preferred embodiment of a digital circuit arrangement according to the invention for evaluating picture rasters.

Referring now to FIG. 1, there is shown a video camera 1, which as known and as mentioned above, is directed toward the edge of a moving band or tape of material and functions as an optoelectronic converter. Connected to the output of the camera 1 is a circuit 1*a* which generates voltage pulses from the scanned picture elements of a line of an optical picture raster and detects sudden changes in contrast in the optoelectronic picture. These voltage pulses produced by the circuit 1*a* are fed to a picture element counter 2 which counts the number A of picture elements from the beginning of a line until the occurrence of a sudden change in contrast in each line of the optoelectronic picture raster which consists of a time sequence per se of the above-mentioned voltage pulses. The number A counted in counter 2 for each line is compared with the counting content B of a second counter 3, which forms the output counter of the circuit, by means of a comparator 4, which in this embodiment is a digital comparator since the number A and the number B are digital values. The stored content B of counter 3 constitutes the desired position of a tape edge of each picture line which position has been given by a preceding setting of counter 3, e.g., initially B=128 picture elements, if the lines of the picture raster are each divided into 256 picture elements. The output of the counter 3 is connected additionally to the input of a digital/analog converter 5 wherein the counter content B is converted to an analog electrical signal which then is processed into a setting instruction to mechanically adjust the tape position.

As shown, the digital comparator 4 has three outputs 41, 42, 43 at which signals are provided corresponding to the particular results of the comparison. In particular, the comparator 4 will provide, for each line of the raster picture, a pulse at output 41 if A<B, a pulse at output 42 if A>B and a pulse at output 43 if A≈B, i.e., A is slightly less or slightly greater than B.

Connected between the digital comparator 4 and the output counter 3 is a precounter 6 having two inputs 61 and 62 and two outputs 63 and 64. The two inputs 61 and 62 are connected to the outputs 42 and 41, respectively, of the digital comparator 4 so that the line information A>B is fed to the input 61 and the information A<B is fed to the input 62. The two outputs 63 and 64 of the precounter 6 are fed, respectively, to the inputs 31 and 32 of the output counter 3 which serves as a memory for having a counting content of picture elements corresponding to the previously detected tape position.

The precounter 6 is a bidirectional counter which is advanced by one count whenever a signal appears at input 61 indicating that A>B and set back by one count whenever a signal appears at input 62 indicating that A<B. The precounter 6 algebraically adds its input signals at inputs 61 and 62 and is reset to its starting state whenever a given value is algebraically reached, at which time it emits an output signal on output 63 or 64 which is fed via input 31 or 32, respectively, to the counter 3 to cause same to change its counting state by a plus one or a minus one, respectively. This changed value is fed to the digital to analog converter 5 to provide the desired analog correction signal.

As mentioned above, at the output 43 of the comparator 4, an information signal is emitted for each raster picture line in which A≈B. Such signals are counted by means of a subsequent further counter 7 (monitoring counter) which counts the raster picture lines.

An interference report is made at the output of counter 7, for example, if for a preselected minimum number of lines the information A≈B is not correct. The preselection is made by means of a preselection switch 7*a* which is connected to the second input 72 of the counter 7.

Although the circuit of FIG. 1 is preferred, it is possible, according to a modification of the invention, as mentioned above, to utilize the circuit of FIG. 1 with the precounter 6 not included in the evaluation circuit.

In such case, the outputs 41 and 42 of the comparator 4 are directly connected with the inputs 32 and 31, respectively, of the output counter 3 and directly cause the count B of counter 3 to be changed by plus one or minus one depending on whether A>B or A<B, respectively.

It should further be noted that it is possible to operate the system according to the invention of FIG. 1, either with or without the precounter 6, without providing the monitoring counter 7. If a monitoring counter 7 is possibly also not used, then the digital comparator 4 need have only two outputs 41 and 42.

Figure 2:
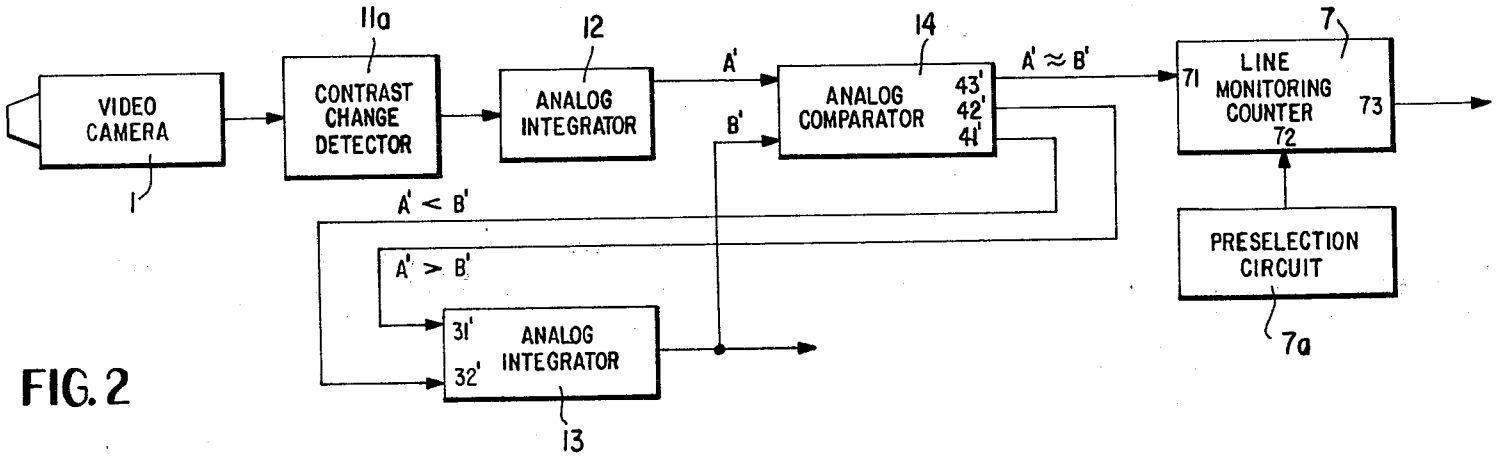
FIG. 2 is a block circuit diagram of an embodiment of an analog circuit arrangement according to the invention for evaluating picture rasters.

Turning now to FIG. 2, there is shown a circuit according to the invention for evaluating picture rasters utilizing analog techniques. In this circuit, the optoelectronic picture raster is again scanned line-by-line to detect the sudden changes in contrast in each line and the output of the contrast change detection circuit 11*a* is fed to an analog integrator 12 which is started at the beginning of a line and stopped when there is a sudden change in contrast. The analog output signal A′ of the integrator 12 is fed to one input of an analog comparator 14 which compares same with the analog output signal B′ from a second analog integrator 13 which acts as the output memory of the circuit and employs an analog voltage which corresponds to the previously detected tape position. The analog output signal B' of integrator 13 is processed directly, i.e, without the need for a converter such as converter 5 of FIG. 1, into a setting instruction for mechanically adjusting the position of a tape-shaped material. The analog comparator 14 has three outputs 41', 42' and 43' with the outputs 41' and 42' being connected with the inputs 32' and 31', respectively, of the analog integrator or output memory 13, and the output 43' being connected to the monitoring counter 7. The comparator 14 is designed such that a small voltage value is emitted at the output 42', so that during the time of a picture line the output voltage of the integrator or memory 13 is increased, if the output voltage of the analog integrator 12 at the time of the sudden change in contrast is greater than the output voltage of the memory 13, i.e., $A'>B'$, and such that a voltage of the opposite polarity and with the opposite effect on the output voltage of memory 13 is emitted at the output 41' if the output voltage of the analog integrator 12 at the time of the sudden change in contrast is less than the voltage stored in the memory 13, i.e., $A'<B'$. In general, the components 12, 13 and 14 are connected together in the same manner as the corresponding components in the above-described digital evaluation devices.

It is to be understood that the above description of the present invention is susceptible to various modifications, changes and adaptations, and the same are intended to be comprehended within the meaning and range of equivalents of the appended claims.

What is claimed is:

1. In an apparatus for evaluating optoelectronically generated picture rasters wherein, for the purpose of regulating the movement of a tape-shaped material (tape), the tape position is detected, with the aid of a video camera, by means of continuously reproducing an edge of the tape or a marking line on the tape as a sudden change in contrast, said apparatus including means for scanning each picture raster line-by-line to provide a sequence of pulses corresponding to the number of picture elements and for detecting a sudden change in contrast in the line, picture element counter means for counting the picture elements in each line occurring up to the selected sudden change in contrast (A), a digital-/analog converter, and first circuit means connecting the output of said picture element counter means to the input of said digital/analog converter, whereby said converter provides an analog output signal which forms a setting instruction to mechanically adjust the tape position to the desired position; the improvement wherein said circuit means comprises: second counter means, having its output connected to the input of said digital/analog converter, for providing a counting content (B) of picture elements corresponding to the previously detected tape position, said second counter means having first and second inputs for causing the count stored therein to be increased or decreased, respectively; digital comparator means, having first and second inputs connected to said outputs of said picture element counter means and said second counter means, for comparing the count outputs of said picture element counter means and said second counter means to provide an output pulse at a first output whenever the number (A) of picture elements counted in one line of the picture raster until the occurrence of a sudden change in contrast is greater than the number (B) of picture elements stored in said second counter means ($A>B$), and to provide an output pulse on a second output whenever the number (A) of picture elements counted in one line of the picture raster until the occurrence of a sudden change in contrast is less than the number (B) of picture elements stored in said second counter means ($A<B$); and second circuit means for connecting said first and second outputs of said digital comparator means to said first and second inputs of said second counter means.

2. The apparatus defined in claim 1 wherein: said second circuit means comprises precounter means having first and second inputs connected to said first and second outputs, respectively, of said digital comparator means, and first and second outputs connected respectively to said first and second inputs of said second counter means; said precounter means is responsive to the output signals from said digital comparator means for advancing its count by one whenever an input pulse is received at said first input ($A>B$), for setting back its count by one whenever an input pulse is received at said second input ($A<B$), and for emitting an output signal, which changes the counting content of said second counter means by plus or minus one, and returning to its starting state whenever its counting content reaches a given value due to algebraic addition of its input signals.

3. Apparatus as defined in claim 1 wherein said second circuit means comprises direct connections between said first and second outputs of said digital comparator means and said first and second inputs of said second counter means whereby the count stored in said second counter means is changed by plus or minus one, depending on whether the number of picture elements counted in one line of the picture raster until the occurrence of a sudden change in contrast is greater or smaller, respectively, than the number of picture elements stored in said second counter means.

4. Apparatus as defined in claim 2 or 3 wherein said digital comparator means has a third output at which an output pulse is emitted whenever the number of picture elements (A) counted in a line of a picture raster until the occurrence of a sudden change in contrast is only slightly less or more than said number of picture elements (B) stored in said second counter means; and further comprising monitoring counter means, having a first input connected to said third output of said digital comparator means, a second input for receiving a signal corresponding to a preselected minimum number, and a single output, for monitoring the lines of said picture raster by counting the pulses appearing at its said first input and providing an output signal at its output only if the number of counted pulses is less than said preselected minimum number.

5. In an apparatus for evaluating optoelectronically generated picture rasters wherein, for the purpose of regulating the movement of a tape-shaped material (tape), the tape position is detected by means of a video camera by a continuous reproduction of one edge of the tape or a marking line on the tape in the form of a sudden change in contrast, said apparatus including means for scanning each picture raster line-by-line and for detecting a sudden change in contrast in a line, and first analog integrator means, responsive to the output signal from said scanning means in each line, for starting its integration at the beginning of each line and stopping same upon detection of a sudden change in contrast whereby an analog output signal is produced which is used to form a setting instruction for mechanically adjusting the tape position to the desired position; the improvement comprising: a second analog integrator means, serving as the output memory circuit of said apparatus, for storing an analog voltage which corresponds to the previously detected tape position, said second analog integrator having first and second inputs and an output and being responsive to an input signal at said first input to increase its output voltage and to an input signal at its second input to reduce its output voltage; and an analog comparator means, having first and second inputs connected to the respective outputs of said first and second analog integrator means, and first and second outputs connected to said first and second inputs, respectively, of said second analog integrator means for comparing the output voltages of said first and second analog integrator means and for producing a small voltage amount at its said first output, so as to increase the output voltage of said second analog integrator means during the time of a line, if the output voltage of said first analog integrator means is greater at the time of the sudden change in contrast than the voltage of said second analog integrator means, and a voltage of the opposite polarity, with the opposite effect, at its said second output if the output voltage of the first analog integrator means at the time of the sudden change in contrast is less than the voltage of said second analog integrator means.

* * * * *